United States Patent [19]

Phillips

[11] Patent Number: 5,020,791

[45] Date of Patent: Jun. 4, 1991

[54] AQUATIC EXERCISE DEVICE

[76] Inventor: Edward D. Phillips, 7258 Warwick, Reynoldsburg, Ohio 43068

[21] Appl. No.: 357,229

[22] Filed: May 26, 1989

[51] Int. Cl.[5] ..... A63B 31/00

[52] U.S. Cl. ..... 372/71; 114/253

[58] Field of Search ..... 272/71, 1 B; 434/255; 114/311, 253; 441/23, 28, 29, 6; 446/153, 154, 155, 160, 161

[56] References Cited

U.S. PATENT DOCUMENTS

| | | | |
|---|---|---|---|
| 1,025,497 | 5/1912 | Wensley | 441/6 |
| 1,098,977 | 6/1914 | Rouse | 114/311 |
| 3,226,114 | 12/1965 | Swider | 114/311 X |
| 3,793,761 | 2/1974 | Bonham | 446/154 X |
| 4,302,007 | 11/1981 | Oprean et al. | 272/71 X |

FOREIGN PATENT DOCUMENTS

| | | | |
|---|---|---|---|
| 1599666 | 10/1981 | United Kingdom | 441/6 |

*Primary Examiner*—Richard J. Apley

*Assistant Examiner*—D. F. Crosby

*Attorney, Agent, or Firm*—Biebel, French & Nauman

[57] ABSTRACT

An aquatic exercise device is provided having a housing with a convex front wall and a concave rear wall, a top surface and a bottom surface. The front wall and rear wall have attached thereto preferably a harness to permit the towing of the device. The housing has a first interior cavity, a second interior cavity, and a water inlet valve, with both the second interior cavity and the water inlet valve having closures. The water inlet valve depends downwardly from the bottom of the housing. The second interior cavity has a compartment having a wall with an aperture therethrough, through which aperture is inserted a hose member having two ends. One end extends through the aperture into the first interior cavity while the other end has air passage therethrough regulated from an air flow control valve. The top of the housing has fixed thereto a flag pole with a preferably brightly colored flag.

16 Claims, 3 Drawing Sheets

AQUATIC EXERCISE DEVICE

BACKGROUND OF THE INVENTION

The present invention relates generally to a buoyant aquatic device, and more particularly, to such a device as can be used in connection with exercise or physical therapy.

There is increased interest in exercises and exercise devices which can develop and maintain the cardiovascular system. Studies have shown that aerobic exercises are most beneficial, however many types of aerobic exercise such as running or even speed walking, have the potential to damage joints.

Concurrently, medical science has experienced great success in joint replacements, especially those involving the hip. Following joint replacement surgery, the patient undergoes physical therapy, with such therapy normally being limited to exercises which increase flexibility and load bearing capacity. Such exercises can be painful, and normally require significant expenditures of energy. In older adults, where hip replacement surgeries are more common, the stimulation associated with such exercise often deters the individual from optimum physical therapy.

It has long been recognized that swimming is an excellent physical conditioner. Furthermore, exercising in heated pools stimulates blood flow, while considerably reducing the force exerted against the body. Thus, while swimmers and joint replacement patients can exercise in aquatic environs, no aquatic device has been provided to assist both the athlete and the individual undergoing physical rehabilitation.

It is thus apparent that the need exists for an aquatic device for use by athletes or individuals requiring physical therapy, which device enhances aquatic aerobic exercise as well as strengthening and toning muscles.

SUMMARY OF THE INVENTION

The problems sought to be overcome by the present invention are overcome by an aquatic device comprising a housing having a convex front wall and a concave rear wall, a top, and a bottom. The housing has a first interior cavity and water inlet means, with the water inlet means having sealing means. The housing also includes a second interior cavity which also has sealing means. The water inlet means depends downwardly from the bottom of the housing. The second interior cavity comprises a compartment having a wall, with the wall having an aperture therethrough. The compartment contains a hose member having two ends, one of which extends through the aperture into the first interior cavity, while the other end of the hose is held closed by clamping means.

The front wall of the housing has attached thereto means which permit the towing of the aquatic device, while the rear wall has a similar attachment means for towing of the device in the opposite direction. Towing of the device may be accomplished through the use of a harness worn by the user of aquatic device and used in combination with the device, such that the harness is connected to the device. The harness has a plurality of points of attachment for such that it is selectably connectable to the device.

On top of the housing is affixed a flag pole, which is pivotally adjustable. The housing also includes a pair of sidewalls which are parallel to each other. The top and bottom of the housing are also parallel to one another.

Adjacent the top of the housing is a buoyant layer, formed of a floatable material.

It is the primary object of the invention to provide an aquatic device which is conveniently and inexpensively formed which assists in the providing of aerobic and therapeutic exercise.

Yet another object of the present invention is to provide an aquatic device whose resistance when towed through the water can be varied.

It is yet another object of the present invention to provide an aquatic exercise device which can be used in conjunction with various muscle groups.

Other objects and advantages of the invention will be apparent from the following description, the accompanying drawings, and the appended claims.

DETAILED DESCRIPTION OF THE INVENTION

Figure 1:
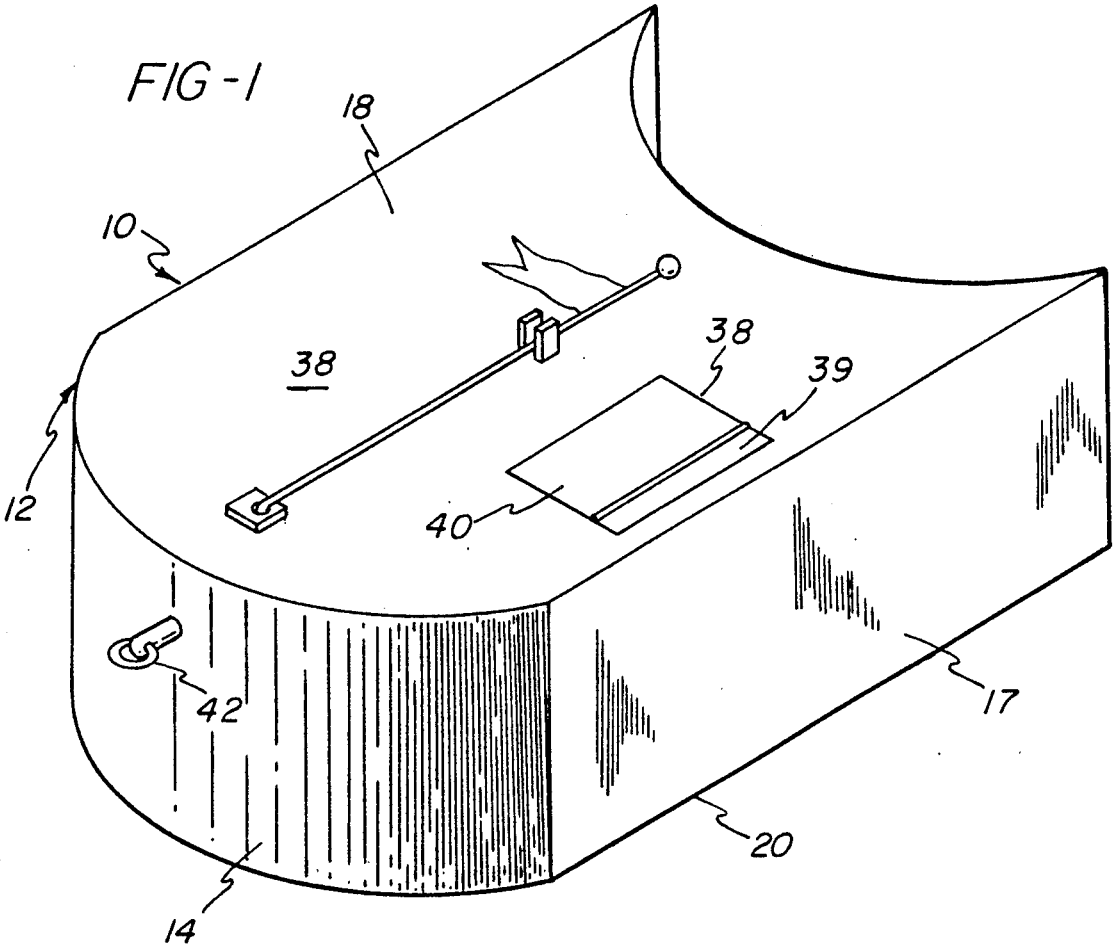
FIG. 1 is a perspective view of an aquatic device in accordance with the present invention.

Having reference to the drawings, attention is directed first to FIG. 1 which illustrates an aquatic device embodying this invention designated generally by the numeral 10. The aquatic exercise device 10 generally comprises a housing 12 with a convex front wall 14 and a concave rear wall 16. Opposing sidewalls 17 preferably parallel extend between front wall 14 and rear wall 16. Housing 12 also includes a top surface 18 and a bottom surface 20, both of which are relatively planar in the preferred embodiment as well as parallel to each other. Preferably the housing is fabricated from a sheet material such as polyurethane, however foamed wall members could be utilized. In addition to be preferably being fabricated from a plastic material, the sidewalls 17 are approximately 5 feet long and separated from one another by 4 feet.

Figure 2:
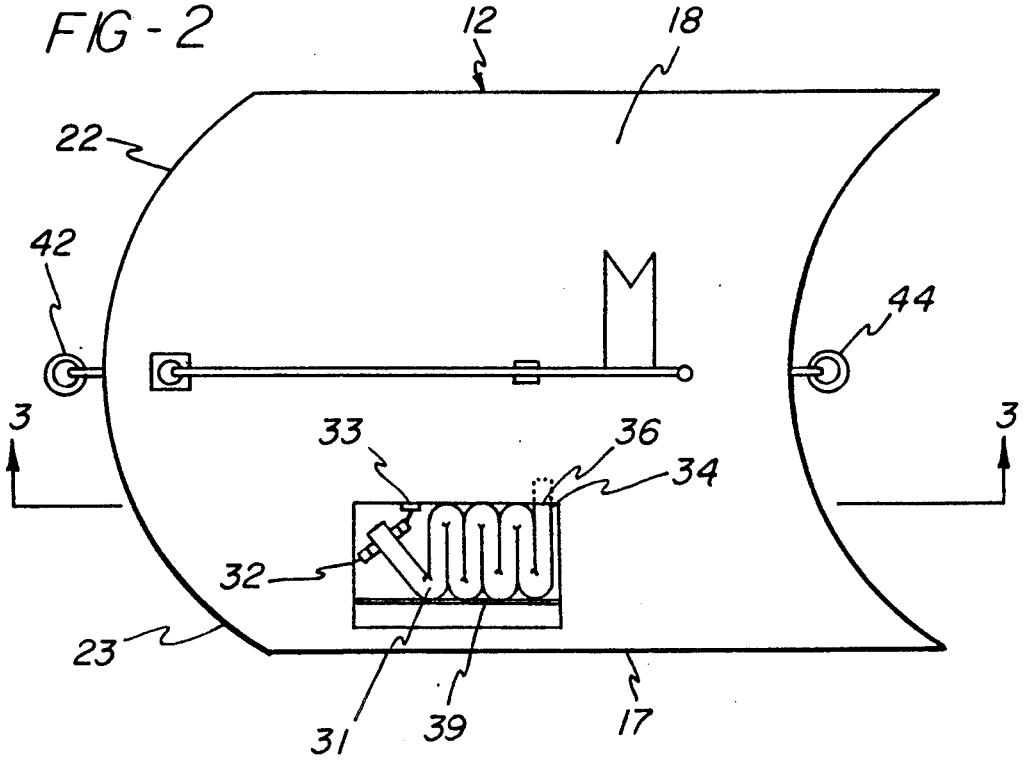
FIG. 2 is a top planned view of FIG. 1, but with the door to the second interior cavity being opened to disclose its contents, with a portion of the hose contained therein being shown in dashed lines.
Figure 3:
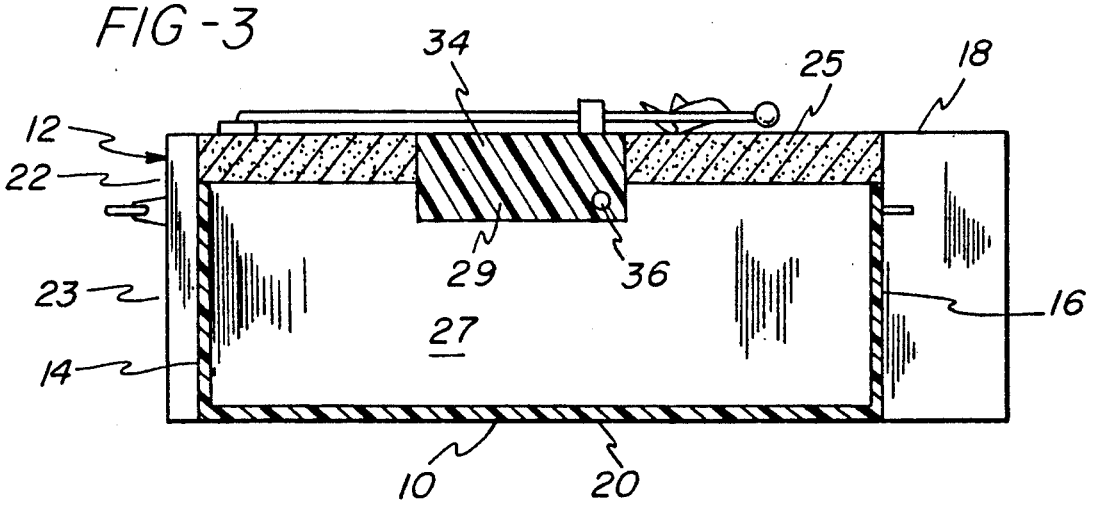
FIG. 3 is a vertical sectional view taken along 3—3 of FIG. 2.

As can be seen in FIGS. 2 and 3, the housing 12 includes an upper portion 22 and a lower portion 23, the upper portion 22 comprising a buoyant layer 25, which can be formed of a floatable material such as a foamed sheet. Lower portion 23 comprises an interior cavity 27, which when the aquatic exercise device 10 is not in use is normally filled with air. When the actual device is in use, the device has been designed such that at least a portion of the first interior cavity 27 will be filled with water. The upper portion 22 is approximately 3" thick while the lower portion 23 is approximately 2 feet deep.

The device 10 is provided with a storage compartment 29 shown as a rectangular box-like structure located near the top surface 18. The storage compartment 29 as shown, preferably extends through the upper portion 22 and into the lower portion 23 of the housing.

Inside the second interior cavity 29 is a hose 31, a clamp 32, and clamp retention means 33. In the storage wall 34 of the compartment 29 is an aperture 36. One end of the hose extends through aperture 36 into the interior cavity 27. The opposite end of the hose 31 is clamped by clamp 32, so as to prevent the flow of air from interior cavity 27 through the hose and into the surrounding atmosphere. To assist in retaining clamp 32 near hose 31, clamp retention means 33 are provided on the storage wall 34 and preferably includes a chain, or cord which secures the clamp 32 to storage wall 34. Preferably the size of the storage compartment 29 permits several feet of hose to be coiled therein. The soft flexible hose 31 is preferably ⅜" in diameter and 3 feet long. The hose is retained in aperture 36 by means of a gasket or other retaining means not shown, so as to permit air to escape from the top of interior cavity 27 only through the opening in hose 31, as controlled by air flow control means 32. Across the top of the storage compartment 29 lies lid 38 which is secured to top surface 18 by an attachment means 39 preferably in the form of a hinge, such that lid top surface 40 is co-planar to top surface 18. Lid 38 thus serves as sealing means for the second interior cavity.

As can be seen in all the drawing figures, means are provided for the towing of the aquatic device. Attached to convex front wall 14 is a front towing swivel 42, while attached to concave rear wall 16 is a rear towing swivel 44. The respective towing swivels can be secured to a rope by an appropriate clip, such as a D-ring. Preferably the rope used with the invention is both lightweight and buoyant, such that nylon rope approximately 5/16" in diameter and 10 feet in length works well with the invention.

A flag 50 atop flag pole 51 is secured by flag pole attachments means 52 to the top surface 18 of the housing 12. The flagpole attachment means 52 preferably is a hinged device which permits the pivotal movement of the flagpole 51. This aspect of the invention is believed to be particularly helpful when the device is being used in large bodies of water. Ideally the flag 50 is fabricated from a highly visible colored material, such as fluorescent orange nylon, thereby permitting visual identification of the presence of an individual in the water nearby, which identification may be helpful for operators of boats or other water enthusiasts such as skiers or fishermen. Pole retention means 54 in the form of a clip, is provided along top surface 18 to assist in storage of the pole 51, when its use is not desired.

Figure 4:
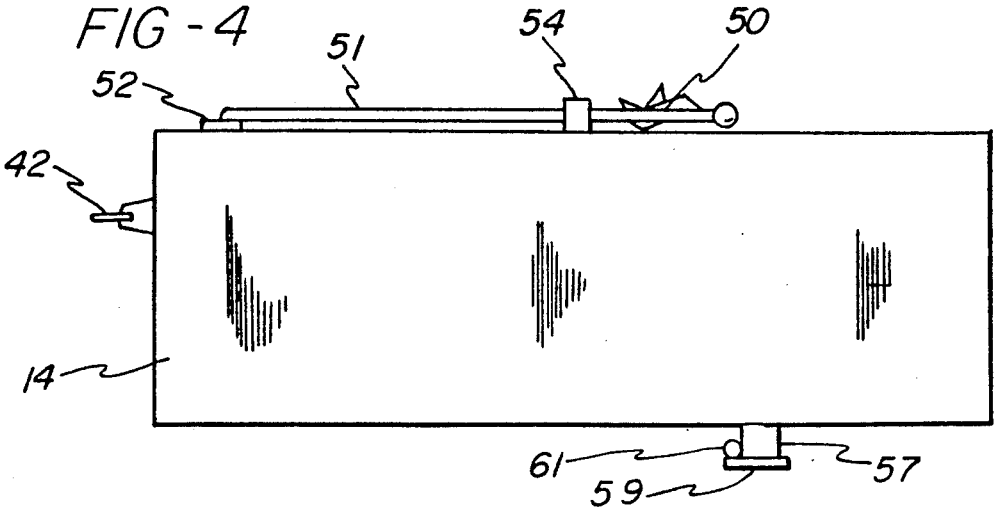
FIG. 4 is a side elevational view taken from the right side of the invention.
Figure 5:
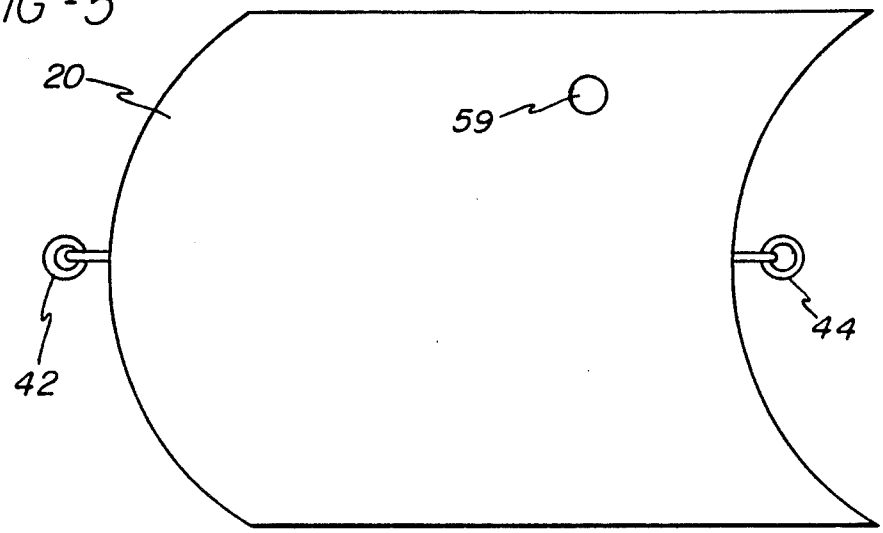
FIG. 5 is a bottom planned view.
Figure 7:
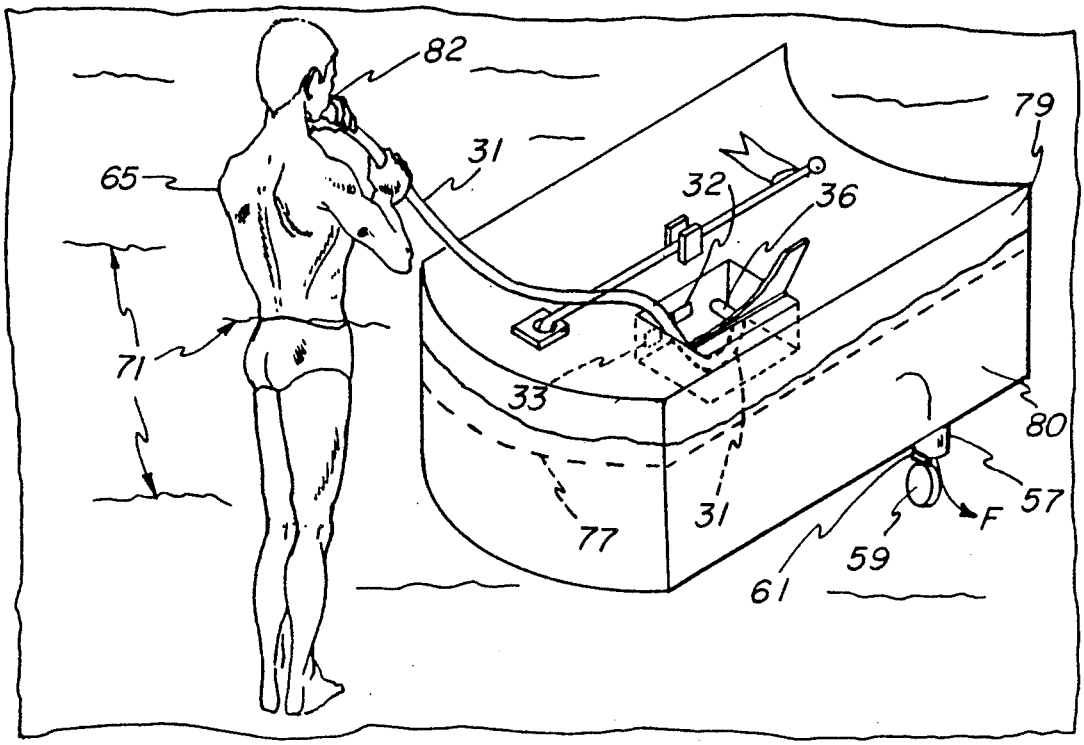
FIG. 7 discloses readying the invention for easy removal from its aquatic environ.

As can best be seen in FIGS. 4, 5 and 7, a water inlet 57 is provided in the lower portion 23 of the device. Preferably this water inlet 57 depends downwardly from bottom surface 20 and includes a water inlet cap 59 secured by cap retention means 61, which cold be in the form of a hinge or interconnecting cord. Thus water inlet 57 serves as sealing means for the first interior cavity.

Figure 6:
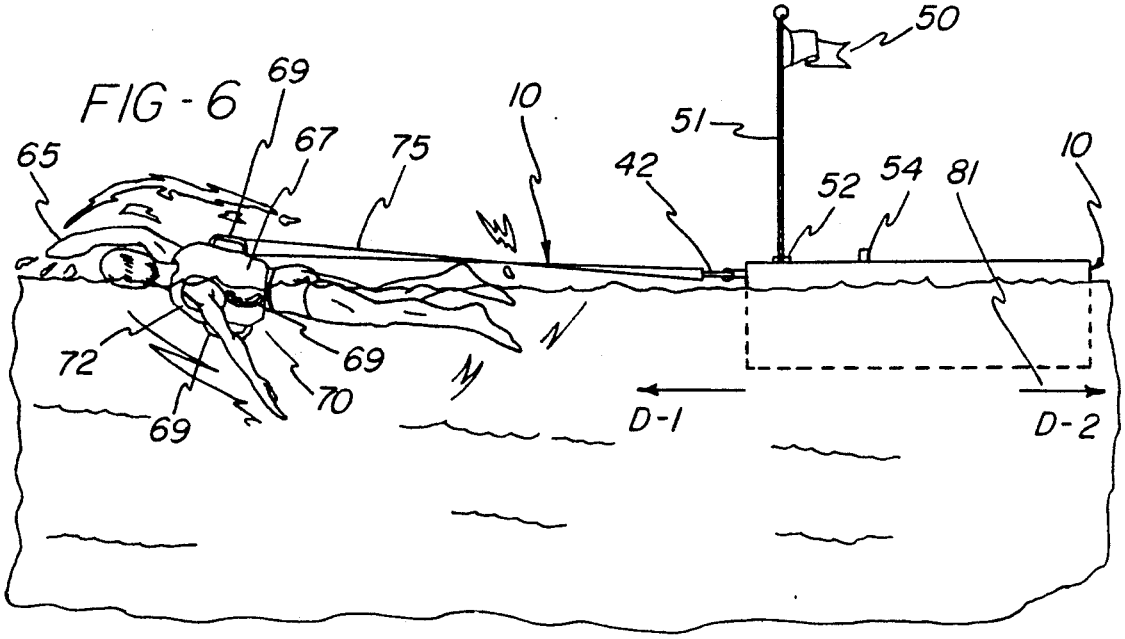
FIG. 6 is a schematic of the invention in its operative embodiment showing it in actual use.

As shown in FIG. 6, the device is designed to be used by a user 65 wearing a harness jacket 67. The harness jacket 67 may resemble a life jacket or vest, preferably having a plurality of rope attachment means such as rings, with at least one ring being secured to the harness front 70, the harness back 71, and each of the harness sides 72. Rope 75 connects the harness jacket 67 to the aquatic device 10.

The device is used in the following manner. An individual places the device in a body of water. Initially the water inlet cap 59 acts as a sealing means with respect to water inlet 57. Furthermore, the air flow control means 32 is positioned so as to restrict air flow from interior cavity 27 through hose 31 into the surrounding atmosphere. Once in the water, the water inlet cap 59 may be temporarily removed. Removal of this cap will cause water to flow through water inlet 57 into the interior cavity 27. At a certain point, no more water will enter into interior cavity 27 due to the pressure associated with the trapped air in the top of the interior cavity. Of course, the water inlet cap 59 may be replaced while water is still flowing into the interior cavity, if it is desired to have a lighter weight associated with the aquatic exercise device. Otherwise, when no more water enters the device, the situation can be remedied by permitting air flow through the hose by adjusting the air flow control means. Preferably this adjustment takes the form of removing the clamping means preferably associated with the air flow control means from about the hose. Air flow control means may comprise a spring hose clamp.

Water will then displace the air within the interior cavity 27, thereby raising the water level 77 within the housing. When the water level has reached a desirable position, the air flow control means can be utilized to close off the passage of air through hose 31. Additionally, the water inlet cap 59 can be secured at water inlet 57, thereby trapping a given amount of water within the interior cavity 27. When completely flooded, the device weighs about 2400 pounds, which permits an athlete using the device to obtain greater towing resistance. The amount of resistance also varies depending upon whether the device is towed from the front in direction D-1 or from the rear in direction D-2 because of the resistance caused by water interaction with a concave as opposed to a convex surface.

When user 65 wishes to remove the device from the water 81, this can be done with the user either standing on land, the bottom of the aquatic body, or while floating. To expel water from the interior cavity 27, lid 38 of storage compartment 29 is opened, and the free end of hose 31 is removed therefrom. Air flow control means 32 is still in place with respect to hose 31, with the free end still being secured to storage wall 34 by clamp retention means 33. User 65 then opens both water inlet 57 and hose 31 and exhales or otherwise provides for the passage of air through hose 31 into the air occupied area 79 in the interior cavity 27. The air pressure inside air occupied area 79 increases, and eventually causes the displacement of water from water occupied area 80 outwardly through water inlet 57 into the surrounding aquatic body. The hose 31 is clamped between exhalations thereby permitting the fairly continuous expulsion of water from the interior cavity 27. As more and more water is expelled from inside the housing, the device becomes lighter in weight, such that the user ultimately may either pull the device from the aquatic body or first close the water inlet 57 and then remove the device from the aquatic body.

In addition to the advantageous uses for this invention discussed above, the invention may also be used as follows: 1) as a diving platform; 2) as a fishing platform; 3) with proper harness and rope at each end, the device can be utilized by two swimmers, swimming in opposite directions away from the device, such that little forward progress of the device and such that maximum physical benefits for both swimmers may be obtained in very small pools of water; 4) the effectiveness of various swimming techniques can be ascertained by comparing the time it takes to pull the device over various distances when the device weighs various amounts, thereby enabling a swimming coach to perfect the technique of the swimmer; 5) as a sun-bathing platform; 6) as a stationary platform, by snapping an anchor to one end of the tow rope with the other end fastened to the device; 7) as a water toy for use in water tug-of-war; 8) as an aid to learn principals of flotation and various swimming strokes by using the device with the flotation harness; 9) as an escape dinghy, since with 1200 pounds of water in the main tank, the device will have about 1500 pounds of positive buoyancy; 10) as a sea anchor for boats when the device is attached at its concave end to the front of a boat endangered by high seas; 11) as a means of controlling or correcting human weight by making the continued use of this device a pleasure to use. (Overweight people can healthfully transform excess weight into immediate muscle, and underweight people can tone up muscles and stimulate appetites to enable them to gain weight, with the exercise routine thus being transformed from pain and work to pleasure and joy with few sore muscles, overworked joints, broken bones, or the discouragements associated with biking, jogging, weight lifting, etc.) 12) to doubly assure safety by fastening two of the flotation devices to the body; and 13) as a means for treating hydrophobia, since non-swimmers can safely use the device in waters that are not over the height of their armpits when they are standing on the bottom of a waterbody, invariably resulting in their learning to swim and thus losing their fear of the water, which is the greatest deterrent to their learning to swim in the first place.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. An aquatic device comprising a housing having a convex front wall and a concave rear wall, a top, and a bottom, said housing having a first interior cavity and a second interior cavity, said second interior cavity having sealing means, and said housing having water inlet means, said water inlet means having water inlet sealing means, said second interior cavity also comprising a compartment having a wall, said wall having an aperture therethrough, said compartment containing a hose member having two ends, one end extending through said aperture into said first interior cavity, the other end being closed by air flow control means.

2. The aquatic device as claimed in claim 1 wherein said water inlet means depends downwardly from said bottom.

3. The aquatic device as claimed inn claim 1 wherein said front wall has attached thereto means to permit the towing of said aquatic device.

4. The aquatic device as claimed in claim 3 wherein said means to permit the towing of said device is connected to a harness, said harness worn by a user of said aquatic device.

5. The aquatic device as claimed in claim 4 wherein said rear wall has attached thereto means to permit the towing of said aquatic device.

6. The aquatic device as claimed in claim 5 wherein said top has affixed thereto a flagpole.

7. The aquatic device as claimed in claim 6 which includes a pair of sidewalls, said sidewalls being parallel to each other, said top and bottom being parallel to one another.

8. The aquatic device as claimed in claim 7 wherein said housing includes a buoyant layer adjacent said top.

9. An aquatic exercise device comprising a housing having a convex front wall and a concave rear wall, said front wall having attached thereto means to permit the towing of said aquatic exercise device, said rear wall having attached thereto means to permit the towing of said aquatic exercise device, said housing also comprising a top, and a bottom, said housing having a first interior cavity and a second interior cavity, said housing having water inlet means with both said interior cavity and said water inlet means having sealing means, said second interior cavity comprising a compartment having a wall, said wall having an aperture therethrough, said compartment containing a hose member having two ends, one end extending through said aperture into said first interior cavity, the other end being closed by air flow control means.

10. The aquatic exercise device as claimed in claim 9 wherein said water inlet means depends downwardly from said bottom.

11. The aquatic exercise device as claimed in claim 10 wherein said top has affixed thereto a flagpole.

12. The aquatic exercise device as claimed in claim 9 which includes a pair of sidewalls, said sidewalls being parallel to each other, said top and bottom being parallel to one another.

13. The aquatic exercise device as claimed in claim 12 wherein said housing includes a buoyant layer adjacent said top.

14. The aquatic exercise device as claimed in claim 13 wherein said means to permit the towing of said device is connected to a harness, said harness worn by a user of said aquatic device.

15. The aquatic exercise device as claimed in claim 14 wherein said device is selectably connectable to said harness at a point of attachment, said harness having more than one point of attachment.

16. An aquatic device comprising a housing having a top and bottom, said housing having means attached thereto to permit the towing of said aquatic device, said means connectable to a harness, said housing having a first interior cavity, a second interior cavity, and water inlet means, said second interior cavity comprising a compartment having a wall, said wall having an aperture therethrough, said compartment containing a hose member having two ends, one end extending through said aperture into said first interior cavity, the other end being closed by air flow control means.

* * * * *